US006371778B1

(12) United States Patent
Watanabe

(10) Patent No.: US 6,371,778 B1
(45) Date of Patent: Apr. 16, 2002

(54) CONNECTOR ASSEMBLY WITH MANIPULATION MECHANISM HAVING GEAR MEMBER AND LEVER MEMBER

(75) Inventor: Masashi Watanabe, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/859,369

(22) Filed: May 17, 2001

(30) Foreign Application Priority Data

Jan. 18, 2001 (JP) ..... 13-010270

(51) Int. Cl.[7] ..... H01R 13/62
(52) U.S. Cl. ..... 439/157; 439/372
(58) Field of Search ..... 439/152–160, 439/372, 341, 310; 361/755, 754, 798; 292/256

(56) References Cited

U.S. PATENT DOCUMENTS 5,629,836 A * 5/1997 Wright ..... 361/755
5,722,843 A * 3/1998 Kerckhof et al. ..... 439/157
5,829,994 A * 11/1998 Oda et al. ..... 439/157
5,928,010 A * 7/1999 Katsuma et al. ..... 439/157
5,997,321 A * 12/1999 Nakata et al. ..... 439/157
6,019,618 A * 2/2000 Nakata et al. ..... 439/157
6,030,235 A * 2/2000 Ittah et al. ..... 439/157
6,039,586 A * 3/2000 Kitamura ..... 439/157
6,045,384 A * 4/2000 Norizuki et al. ..... 439/310
6,099,330 A * 8/2000 Gundermann et al. ..... 439/157
6,186,804 B1 * 2/2001 Smith et al. ..... 439/157
6,241,540 B1 * 6/2001 Tokuwa ..... 439/157
6,264,485 B1 * 7/2001 Saka et al. ..... 439/157

FOREIGN PATENT DOCUMENTS

JP 7-282899 10/1995 ..... H01R/13/629

* cited by examiner

*Primary Examiner*—P. Austin Bradley
*Assistant Examiner*—Alexander Gilman
(74) *Attorney, Agent, or Firm*—Michael Best & Friedrich LLC; Laff, Whitesel & Saret, Ltd.; J. Warren Whitesel

(57) ABSTRACT

A connector assembly (11) includes a connector element (21) for being connected to an counterpart connector (51) in a first direction and a manipulation mechanism (14) for manipulating the connection between the connector element and the counterpart connector. The manipulation mechanism includes a gear member (41) rotatably supported by the connector element and a lever member (45) engaged with the gear member in a rotating direction. The gear member has a gear section as an engaging arrangement for engaging with the counterpart connector in the first direction.

27 Claims, 15 Drawing Sheets

CONNECTOR ASSEMBLY WITH MANIPULATION MECHANISM HAVING GEAR MEMBER AND LEVER MEMBER

BACKGROUND OF THE INVENTION

The present invention relates to a connector assembly having a manipulation mechanism for manipulating connection between the connector assembly and an counterpart connector.

This type of connector assembly is, for example, disclosed in Japanese Unexamined Patent Application Publication No. 7-282899. The connector assembly comprises a connector element for connecting to the counterpart connector in a first direction and a manipulation mechanism connected to the connector element. The manipulation mechanism includes a lever rotatably mounted on the connector element. The lever has an integral gear around the center of rotation. When the connector element is connected to the counterpart connector, the gear engages with the counterpart connector in the first direction.

In order to disengage the connector element from the counterpart connector, the lever is rotated. When the lever is rotated, the gear pushes the counterpart connector in the first direction and applies a force which separates the connector element and the counterpart connector. Consequently, the connector element can easily be disengaged from the counterpart connector.

However, it is difficult to manufacture the lever so that it is integrated with the gear. When the lever is manufactured using a die, for example, the die must be a so-called slide-type die, which has a complicated configuration. Although the lever and the gear must be accurately manufactured, it may be difficult to ensure accuracy when the lever and the gear have an integrated construction. Furthermore, assembling the lever to the connector element is also difficult.

SUMMARY OF THE INVENTION

It is therefore an object of the present invention to provide a connector assembly having a manipulation mechanism in which manufacture and assembly are easy.

Other objects of the present invention will become clear as the description proceeds.

According to an aspect of the present invention, there is provided a connector assembly comprising a connector element for being connected to an counterpart connector in a first direction and a manipulation mechanism for manipulating the connection between the connector element and the counterpart connector, the manipulation mechanism comprising a gear member rotatably supported by the connector element and a lever member engaged with the gear member in a rotating direction, the gear member comprising a gear portion as first engaging means for engaging with the counterpart connector in the first direction.

According to another aspect of the present invention, there is provided a connector assembly comprising a connector element connected to the counterpart connector in a first direction and a manipulation mechanism for performing the connection of the connector element, the connector element comprising an insulating housing and a frame provided at the housing, the housing comprising a plurality of electrically conductive contacts and a fitting section which holds the contacts and is fitted in the counterpart connector, the frame comprising a lever mount which is separately disposed and faces the periphery of the fitting section in a second direction perpendicularly crossing the first direction, the manipulation mechanism comprising a gear member rotatably mounted on the lever mount and a lever member mounted on the lever mount via the gear member in such a manner as to be rotated together with the gear member, the gear member comprising a gear shaft having a first shaft end and a second shaft end, first engaging means provided at the first shaft end of the gear shaft, and second engaging means which is provided at the second shaft end of the gear shaft in such a manner that it deviates from the first engaging means at a predetermined angle of circumference and which protrudes from the periphery of the gear shaft in a radial direction, the first and the second engaging means engaging with the lever mount, the second engaging means engaging with the lever member.

DESCRIPTION OF THE PREFERRED EMBODIMENTS

Figure 1:
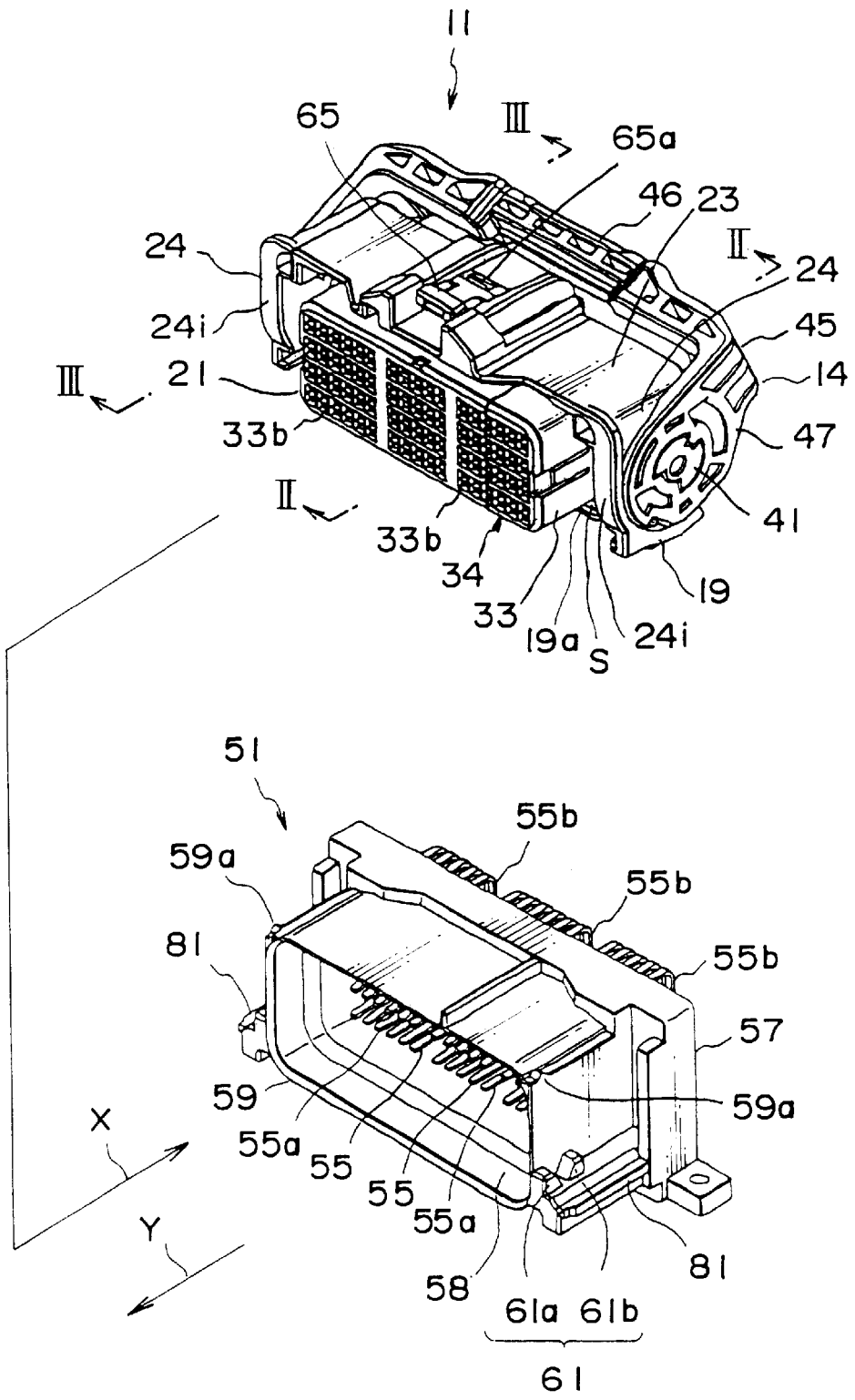
FIG. 1 is a perspective view showing a connector assembly according to an embodiment of the present invention and an counterpart connector.
Figure 2:
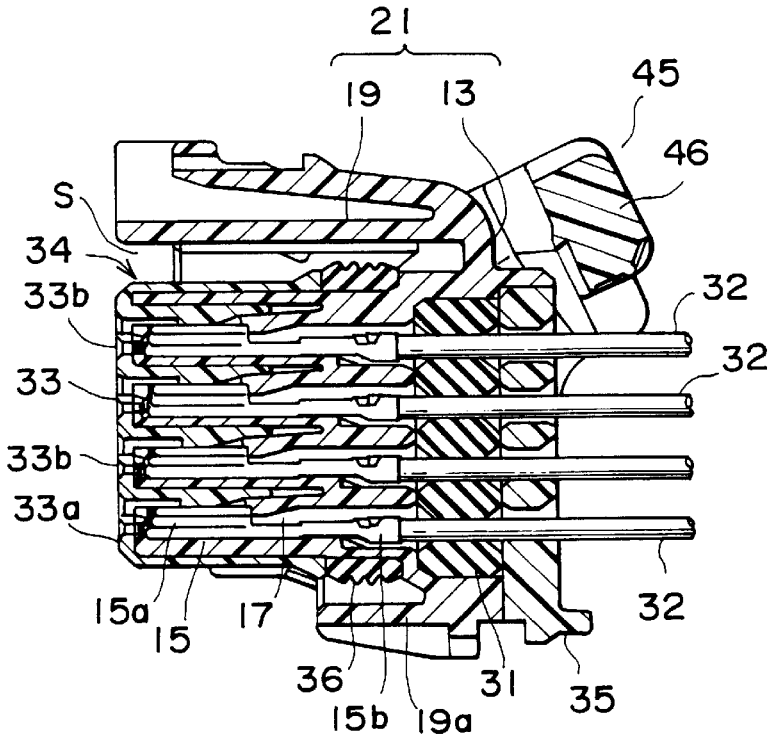
FIG. 2 is a cross sectional view taken along the line II—II in FIG. 1.

Referring to FIGS. 1 and 2, a connector assembly according to an embodiment of the present invention will be described.

A shown connector assembly 11 is for being connected to a counterpart connector 51. The connector assembly 11 comprises an insulating housing 13 and a manipulation mechanism 14 which will be specifically described later. The housing 13 is formed of a resin material and has a substantially rectangular box shape. A plurality of contact enclosing sections 17, in which a plurality of electrically conductive contacts 15 are enclosed, are arranged in line in the housing 13 at specified intervals in the direction along the line.

The connector assembly 11 further comprises a frame 19 which is formed integrally with the housing 13. The frame 19 comprises a planar frame bridge 23 which faces an upper surface of the housing 13 and a pair of lever mounts 24 extending from both ends of the longitudinal side of the frame bridges 23 in such a manner as to face both sides of the housing 13. The housing 13 enclosing the contacts 15 and the frame 19 are collectively called a connector element 21.

Each cable 32 is sealed by a grommet rubber 31 in the housing 13 at the rear part thereof. The front part of the housing 13 is covered by a cap-shaped front cap 33. The front part including the front cap 33 is a fitting section 34 which fits in the counterpart connector 51. The grommet rubber 31 is held in piece by a rear cover 35 at the rear part of the housing 13 so that it does not become disengaged from the housing 13.

An upper surface and a side surface of the fitting section 34 have a predetermined space S relative to the frame 19. Both lower ends of the pair of lever mounts 24 are connected by a connecting frame 19*a*. There is a predetermined space S between a lower surface of the fitting section 34 and the connecting frame 19*a*. The specified space S is the part into which an counterpart fitting section of the counterpart connector 51 is fitted. A sealing member 36 is provided at the outer periphery of the rear part of the fitting section 34. The sealing member 36 prevents water from entering the fitting section 34 from the outside.

The counterpart connector 51 will be described hereinbelow. The counterpart connector 51 comprises a plurality of counterpart contacts 55 and a counterpart insulating housing 57 having a substantially rectangular box shape in which the counterpart contacts 55 are assembled. The counterpart housing 57 has a counterpart fitting section 59 having a large groove 58 therein, which is fitted in the fitting section 34 in such a manner that it covers the fitting section 34. The counterpart contacts 55 include counterpart contact sections 55*a* formed in the groove 58 and counterpart terminals 55*b* protruding from the bottom wall of the groove 58. A pin contact is used as the counterpart contact 55. The counterpart connector 51 is mounted on a board (not shown) such as a printed-circuit board, and is connected thereto in such a way that the counterpart terminals 55*b* are soldered on a circuit pattern formed on the board, or are each press fitted in through holes in the board.

Returning to an explanation of the connector assembly 11, a front wall 33*a* of the front cap 33 faces the housing 13. A plurality of through holes 33*b* for receiving the electrically conductive counterpart contacts 55 of the counterpart connector 51 are formed in the front wall 33*a*. Each of the through holes 33*b* communicate with one of the contact enclosing sections 17.

Each of the contacts 15 is enclosed in one of the contact enclosing sections 17 in a one-to-one corresponding manner. The cables 32 are each connected to one of the contacts 15. The cables 32 pass through the rear cover 35 and are led out to the outside of the connector assembly 11.

Each of the contacts 15 has a contact section 15*a* which comes into contact with one of the counterpart contacts 55, and has a press fitting section 15*b* which comes into contact with one of the cables 32. A socket contact is used as the contact 15.

The manipulation mechanism 14 is a mechanism for performing the connection of the connector assembly 11 to the counterpart connector 51. In other words, the manipulation mechanism 14 can move the connector assembly 11 in a connecting direction X such that the connector assembly is brought into contact with the counterpart connector 51 and in a disconnecting direction Y in order to disengage it therefrom. When the connector assembly 11 moves in the connecting direction X, the fitting section 34 fits in the counterpart fitting section 59 of the counterpart connector 51. When the fitting section 34 fits in the counterpart fitting section 59, each contact 15 comes into contact with and is fitted in the counterpart contact 55 of the counterpart connector 51. When the connector assembly 11 is moved in a disconnecting direction Y from this position, the fitting section 34 is disconnected from the counterpart fitting section 59. As a result, the contact 15 is separated from the counterpart contact 55 such that it is in a non-contact state.

Figure 3:
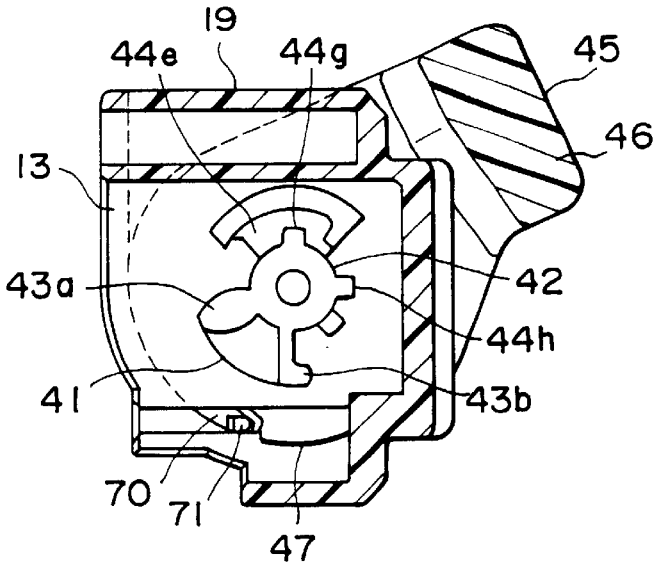
FIG. 3 is a cross sectional view taken along the line III—III in FIG. 1.
Figure 4B:
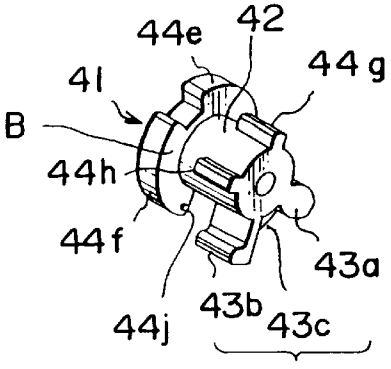
FIG. 4B is a perspective view showing a state in which the gear member shown in FIG. 4A is inverted.
Figure 4A:
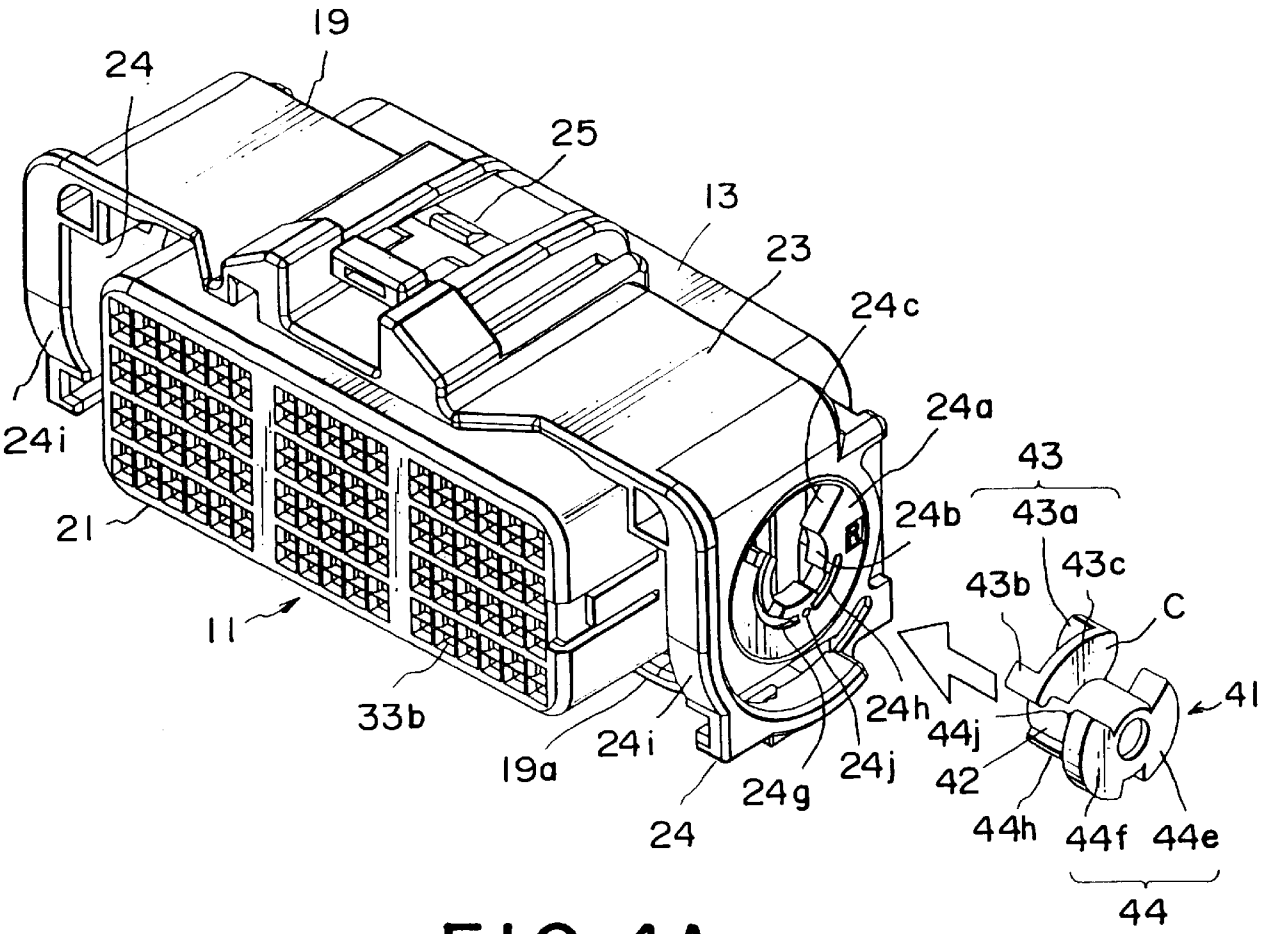
FIG. 4A is an exploded perspective view showing a connector element and a gear member included in the connector assembly in FIG. 1.

Referring to FIGS. 3, 4A, and 4B in addition to FIGS. 1 and 2, the manipulation mechanism 14 will be specifically described hereinbelow.

The manipulation mechanism 14 includes gear members 41, each mounted on the pair of lever mounts 24 of the frame 19, and lever members 45 each of which is rotatably mounted on the lever mounts 24 via the gear members 41. Each of the lever mounts 24 has a gear holding plate 24*a*. The gear holding plate 24*a* has the gear member 41 mounted thereon. The lever member 45 is mounted at the gear holding plate 24*a* via the gear member 41. The lever mounts 24 face both sides of the housing 13, as is most clearly shown in FIG. 4A.

Each of the gear members 41 includes a gear shaft 42 having a cylindrical shape, a first engaging device 43 provided at one end of the gear shaft 42 in an axial direction, that is, at a first end, and a second engaging device 44 provided at the other end of the gear shaft 42 in an axial direction, that is, at a second end. The second engaging device 44 protrudes from the periphery of the gear shaft 42 in a radial direction such that it has a fan shape. The first engaging device 43 and the second engaging device 44 deviate from each other by a specified angle in a peripheral direction.

Each of the lever members 45 includes a lever 46 which can be rotated between a position on the rear side of the housing 13 and a position facing the frame bridge 23 of the frame 19, and a pair of gear-engagement receiving sections 47 are provided in such a manner that they face the lever mount 24 from both sides of the lever 46 so that they engage with the second engaging device 44 of the gear member 41. The lever 46 has a rectangular planar shape. Each end of the gear-engagement receiving sections 47 has a circular planar shape. The pair of gear-engagement receiving sections 47 is connected to the lever 46 such that they can be slightly separated from each other.

The first engaging device 43 of the gear member 41 includes a first gear plate 43*c* protruding from the periphery of the gear shaft 42 in a radial direction such that it has a fan shape and two first gears 43*a* and 43*b* extending from the first gear plate 43*c* on the periphery of the gear shaft 42 in a radial direction at spaced points in a peripheral direction of the gear shaft 42. The second engaging device 44 includes two second gears 44*e* and 44*f* which are formed in a substantially fan shape and which extend in a radial direction from the other end face of the gear shaft 42 in an axial direction.

Two ribs 44*g* and 44*h* are formed on the outer periphery of the gear shaft 42 in such a manner as to protrude therefrom and to extend in an axial direction. The length of the two ribs 44*g* and 44*h* in the axial direction is almost the same as that of the first gears 43*a* and 43*b* in the axial direction. The second gear 44*f* has a gear projection 44*j* protruding from an inward face B in the vicinity of an end of the second gear 44*f*.

The gear holding plate 24*a* has a notch having a shape corresponding to the shape of the first engaging device 43 and is formed in such a manner as to rotatably hold the gear shaft 42 of the gear member 41. The gear holding plate 24*a* has a bearing 24*b* through which the gear shaft 42 of the gear member 41 rotatably penetrates toward the inside of the lever mount 24, and a notch 24*c* having a substantially fan shape and which rotatably receives the first engaging device 43 to the inner side of the lever mount 24.

A pair of guide grooves 24*g* and 24*h*, which is formed in a circular shape and is concentric with the bearing 24*b* in such a manner as to receive the gear projection 44*j* of the gear member 41 and to guide it in the rotating direction, and an engaging hole 24*j*, which is positioned between the pair of guide grooves 24*g* and 24*h*, are provided on the surface of the gear holding plate 24*a* facing the gear projection 41*j*.

The gear projection 44*j* and the engaging hole 24*j* together temporarily form a gear-fixing device for stopping the rotation of the gear member 41 in conjunction with each other. Specifically, the gear projection 44*j* of the gear member 41 fits in the engaging hole 24*j*, thereby temporarily fixing the gear member 41 to the lever mount 24. At the end of each of the pair of guide grooves 24*g* and 24*h* positioned on both sides of the engaging hole 24*j*, as shown in FIG. 5C in cross section, slopes 24*g*' and 24*h*', in which the bottom of the pair of guide grooves 24*g* and 24*h* are inclined toward the surface of the gear holding plate 24*a*, are formed.

Figure 5A:
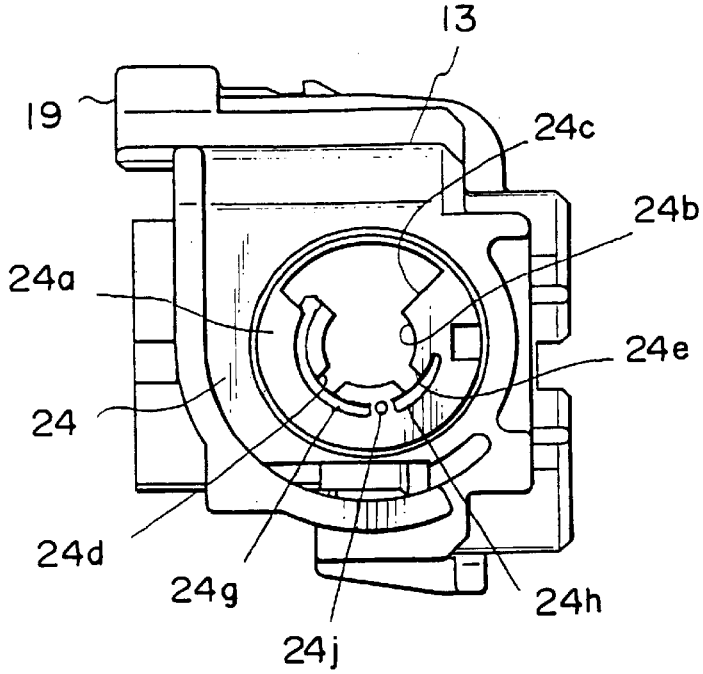
FIG. 5A is a side view of the connector element shown in FIG. 4A.
Figure 5B:
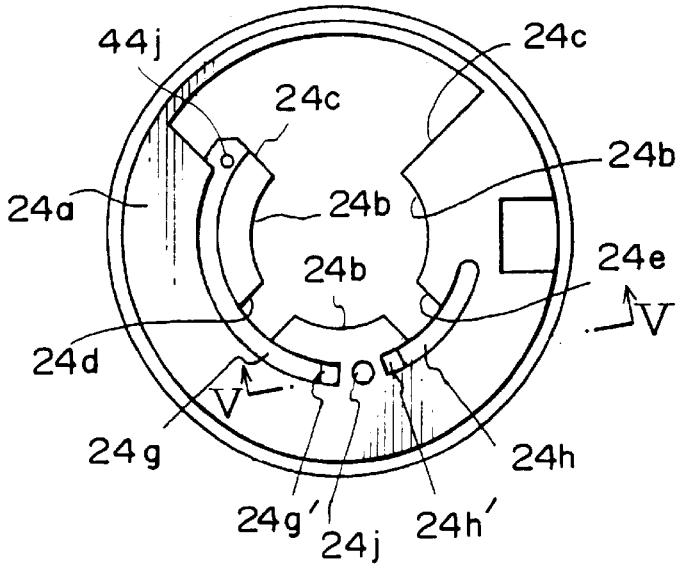
FIG. 5B is an enlarged view of an essential part of FIG. 4A.
Figure 5C:
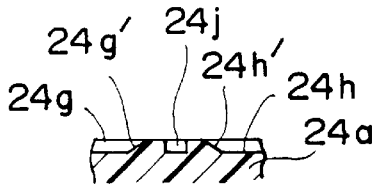
FIG. 5C is a cross sectional view taken along the line V—V in FIG. 5B.
Figure 6:
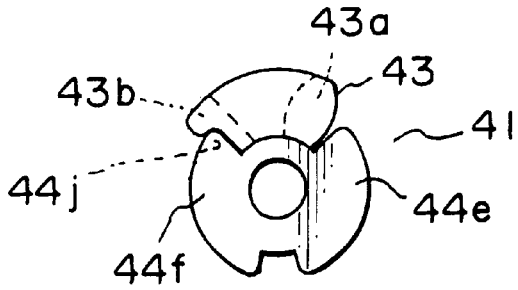
FIG. 6 is a side view of the gear member shown in FIG. 4A.
Figure 7:
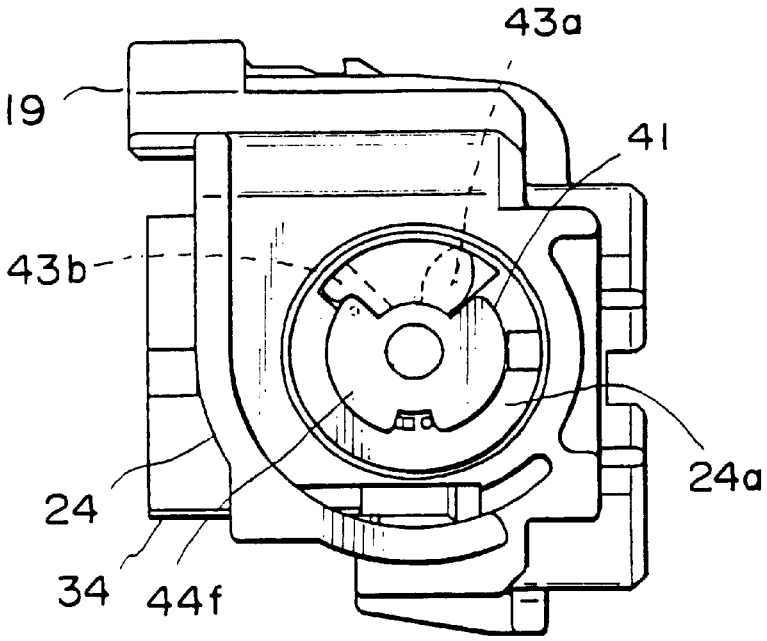
FIG. 7 is a side view showing a state in which the gear member is assembled to the connector element.

The gear holding plate 24*a* has notches 24*d* and 24*e* for ribs in a radial direction from the bearing 24*b* so as to receive the two ribs 44*g* and 44*h* into the housing 13, as shown in FIGS. 5A and 5B. The first gear member 41 shown in FIGS. 3 and 4A and the second gear member, which is inverted with respect to the gear member 41, are mounted on the pair of lever mounts 24.

The first engaging device 43, the gear shaft 42, and the ribs 44*g* and 44*h* of the gear member 41 are fitted in the bearing 24*b*, the notch 24*c*, and the gear notches 24*d* and 24*e* of the gear holding plate 24*a*, respectively. At this time, the gear shaft 42 is rotatably engaged with the notch 24*c*. The first engaging device 43 and the ribs 44*g* and 44*h* are positioned on the inside of the back surface opposite to the surface of the gear holding plate 24*a*. At this time, the gear projection 44*j* is positioned in the vicinity of the inlet of the guide groove 24*g* which is positioned at the farthest position from the slop 24*g*', as shown in FIG. 5B.

Figure 8:
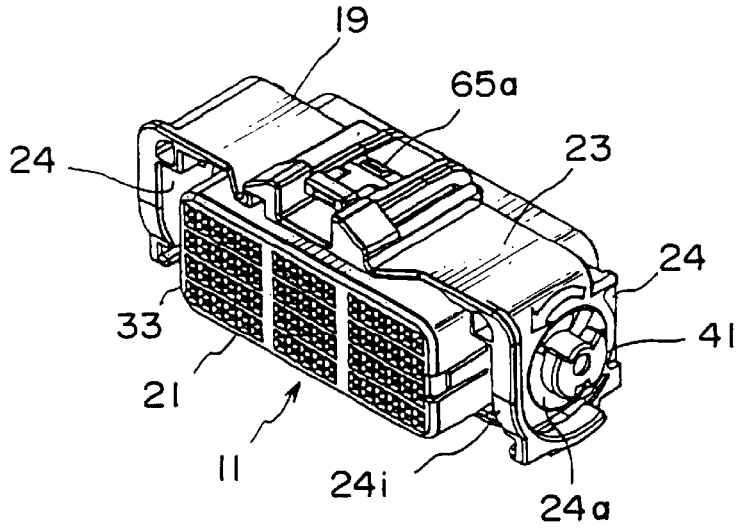
FIG. 8 is a perspective view of the state in FIG. 7.
Figure 9:
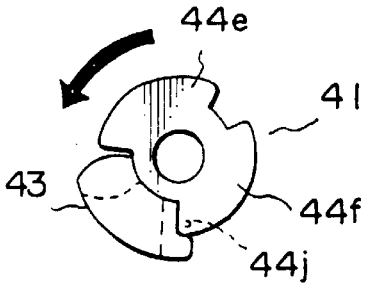
FIG. 9 is a side view for explaining the rotation of the gear member.
Figure 10:
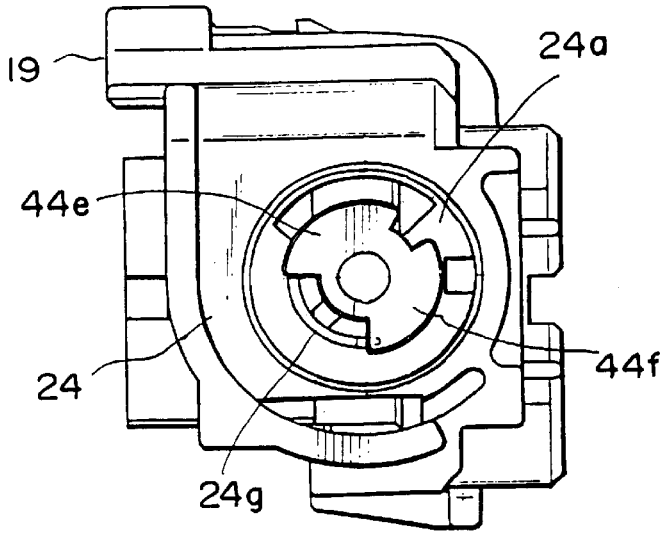
FIG. 10 is a side view showing a state in which the gear member is rotated.

When the gear member 41, which is fitted in the gear holding plate 24*a* of the housing 13 shown in FIG. 8, is rotated counterclockwise to a predetermined position shown by the arrow in FIG. 9, it is moved to a position shown in FIG. 10. At this time, an inward face C (refer to FIG. 4A) of the first gear plate 43*c* slides in contact with the back of the gear holding plate 24*a*.

The inward face B (shown in FIG. 4B) of the second gear plates 44*e* and 44*f* slides in contact with the surface of the gear holding plate 24*a*. At this time, the gear projection 44*j* passes through the slope 24*g*' while moving in the guide groove 24*g* and is fitted in the engaging hole 24*j*. In this state, the gear member 41 is temporarily fixed to the lever mount 24.

In this manner, the gear projection 44*j* has the function of temporarily fixing the gear member 41 to the lever mount 24. The guide groove 24*g* performs the function of an escape groove for preventing the gear projection 44*j*from abutting on the surface of the gear holding plate 24*a* and from being crushed when the gear projection 44*j* passes along the surface.

While the inward face B of the second gear plates 44*e* and 44*f* comes into contact with the surface of the gear holding plate 24*a* with a large arc of rotation, the inward face C of the first gear plate 43*c* comes into contact with the back of the gear holding plate 24*a* with a smaller arc of rotation than that of the inward face B. Accordingly, since there is a possibility that the gear member 41 will rattle, it is constructed in such a manner that an end face which perpendicularly crosses the length of the ribs 44*g* and 44*h* comes into contact with the back of the gear holding plate 24*a*.

Figure 11:
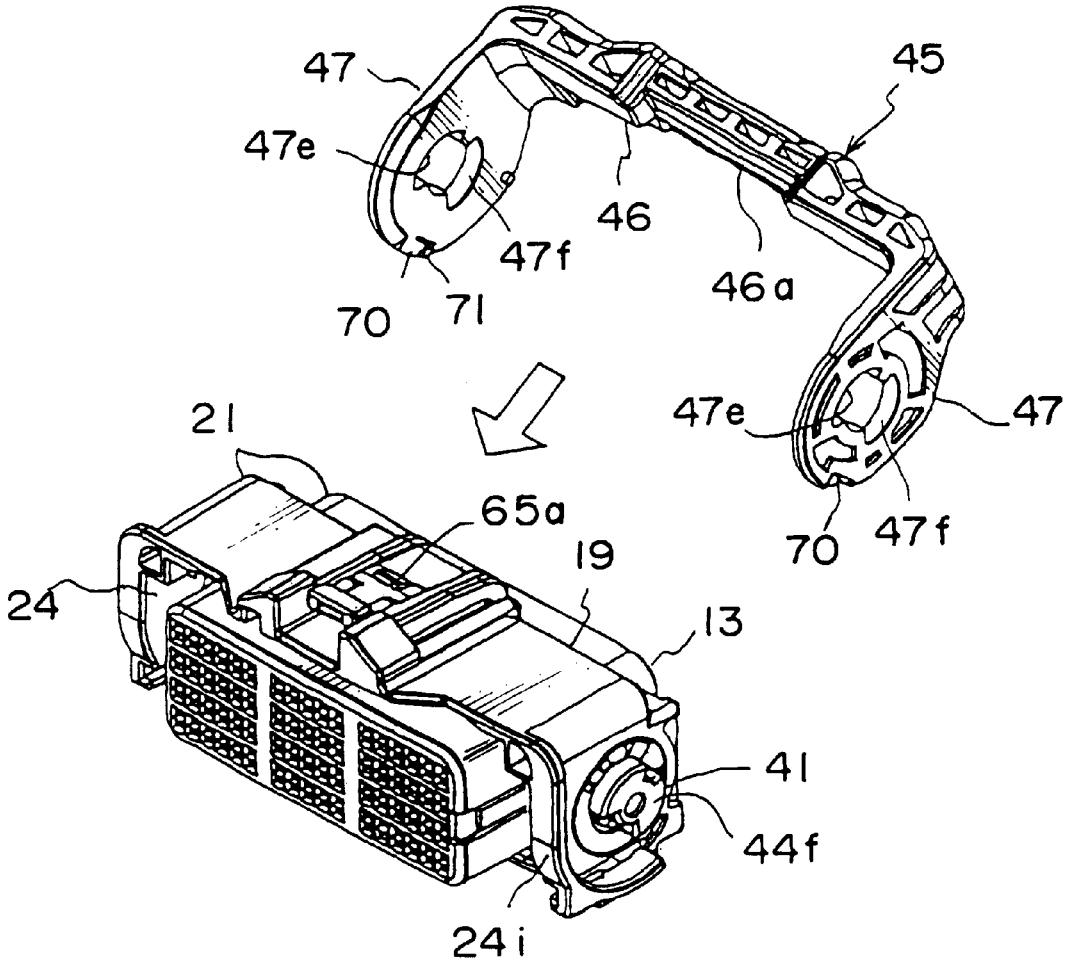
FIG. 11 is an exploded perspective view of the connector assembly shown in FIG. 1.
Figure 12A:
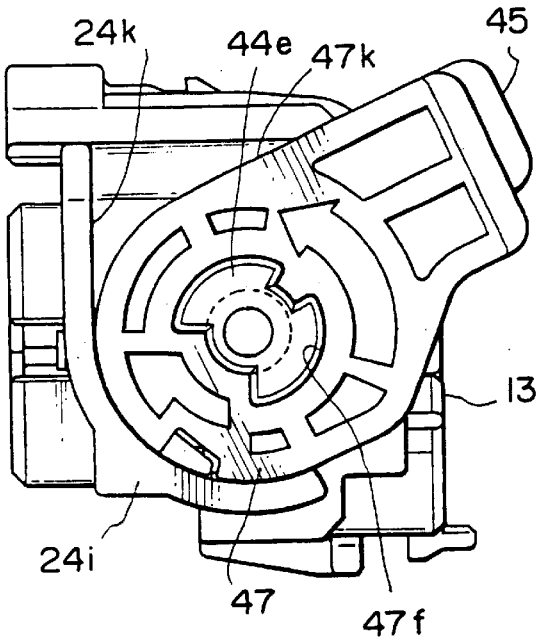
FIGS. 12A and 12B are side views for explaining the operation of the connector assembly shown in FIG. 1.

After the gear member 41 is temporarily fixed to the gear holding plate 24*a*, the gear-engagement receiving section 47 of the lever member 45 is engaged with the second gear plates 44*e* and 44*f* to combine them, as shown in FIGS. 11 and 12A. The gear-engagement receiving section 47 has lever engaging holes 47*e* and 47*f* each having the same shape as that of the second gear plates 44*e* and 44*f* so that they can be fitted therein.

Figure 12B:
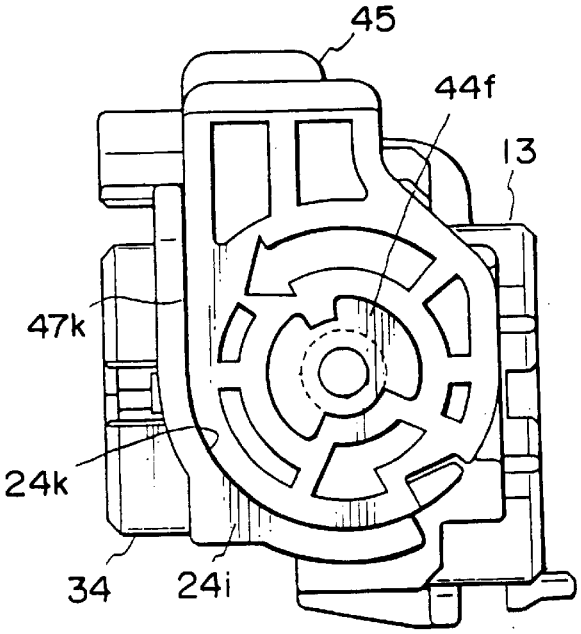

The connector element 21 and the lever member 45, which are assembled as described above, are inclined in such a manner that the lever 46 of the lever member 45 is positioned at the back of the frame bridge 23 of the frame 19, as shown in FIG. 1. The connector assembly 11 can be fitted in the counterpart connector 51 in a state in which the lever member 41 is temporarily fixed to the connector assembly 11 shown in FIG. 1. More specifically, when, after the lever member 45 is fitted in and engaged with the second gear plates 44*e* and 44*f*, the lever member 45 in a state shown in FIG. 12A is rotated counterclockwise, the connector assembly 11 can be fitted in the counterpart connector 51 shown in FIG. 1 by the rotation of the lever member 45, as shown in FIG. 12B. At this time, the gear projection 44*j*, which is engaged with the engaging hole 24*j*, comes out from the engaging hole 24*j* and moves to a predetermined position at the guide groove 24*h* via the slope 24*h*'.

Returning to FIG. 1, the counterpart connector 51 has a counterpart engaging device 61 which is engaged with the first engaging device 43 in order that when the gear member 41 is rotated from the state shown in FIG. 12A to the state shown in FIG. 12B, the connector element 21 can be moved in the connecting direction X and in the disconnecting direction Y.

The counterpart engaging device 61 has two counterpart gears 61*a* and 61*b* which protrude from the lower part of a pair of outer sides of the counterpart fitting section 59. The counterpart gears 61*a* and 61*b* are integrally formed with the counterpart housing 57 at a specified distance so as to receive the first engaging device 43 in the connecting direction X and in the disconnecting direction Y.

Figure 13A:
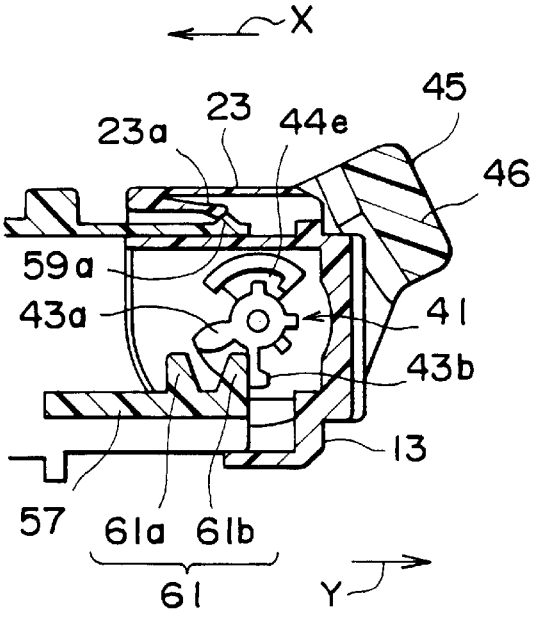
FIGS. 13A to 13D are cross sectional views of an essential part, for explaining the operation of the gear member.
Figure 13B:
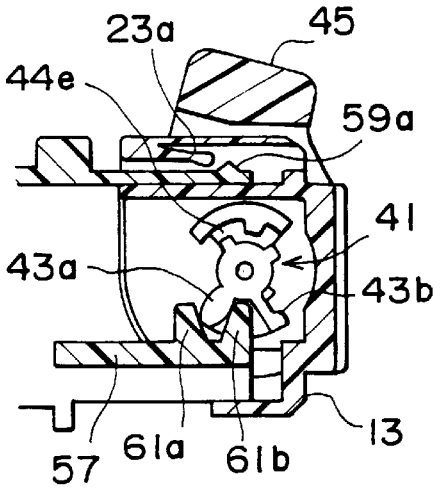
Figure 13C:
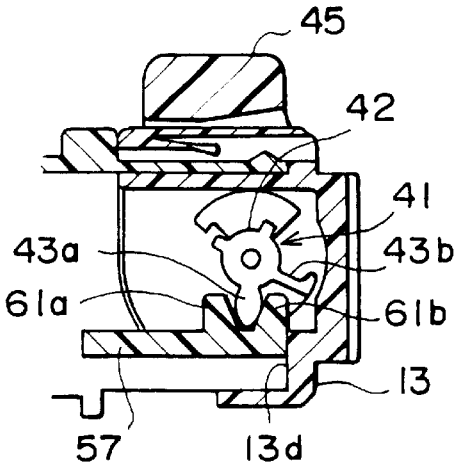

Referring to FIGS. 13A to 13C, the operation of connecting the connector assembly 11 to the counterpart connector 51 will be described.

FIG. 13A shows a state in which the lever member 45 is temporarily fixed to the gear holding plate 24, and a state in which the connector assembly 11 is temporarily connected to the counterpart connector 51. At this time, the end face of the counterpart housing 57 in the connecting direction X is in contact with the first gear 43*b*, and the other first gear 43*a* is positioned above the counterpart gears 61*a* and 61*b*.

When the lever 46 of the lever member 45 is moved toward above the frame bridge 23 of the frame 19, as shown in FIG. 13B, since the gear-engagement receiving section 47 of the lever member 45 rotates the gear member 41, the first gear 43*a*, one of the two first gears 43*a* and 43*b*, enters between the two counterpart gears 61*a* and 61*b*, and the first gear 43*a* presses the counterpart gear 61*b* and moves the connector assembly 11 in the connecting direction X. Furthermore, when the lever 46 of the lever member 45 is moved right above the frame bridge 23 of the frame 19, a moving operation of the lever member 45 is completed, as shown in FIG. 13C.

The lever mount 24 has a rotation control plate 24*i* protruding upward from the surface of the gear holding plate 24*a*, as shown in FIGS. 1, 4, 12A, and 12B. Since an end face 47k of the lever member 45 shown also in FIGS. 12A and 12B comes into contact with an abutment 24*k* of the rotation control plate 24*i* of the lever mount 24, the movement of the lever member 45 is stopped.

Figure 13D:
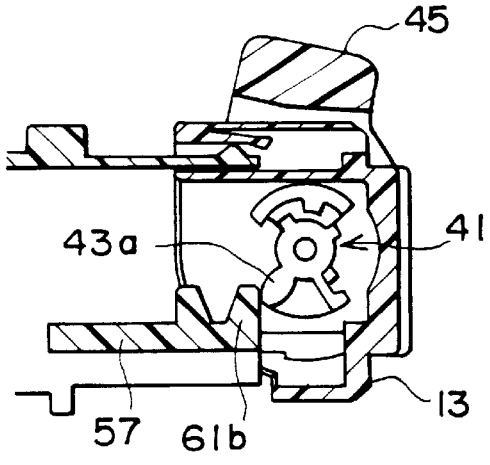

FIG. 13D shows a state in which the connector assembly 11 is not temporarily connected to the counterpart connector 51. More specifically, assuming that the gear member 41 is positioned at FIG. 13B position, the first gear 43*a* cannot go between the two counterpart gears 61*a* and 61*b*, so that it cannot press the counterpart gear 61*b* and cannot move the connector assembly 11 in the connecting direction X.

As described above, since not only the inward face C of the first gear plate 43*c* comes into contact with the inner surface of the gear holding plate 24*a*, but also the ribs 44*g* and 44*h* come into contact with the back of the gear holding plate 24*a*, the gear member 41 is hardly loosened during rotation.

Figure 14:
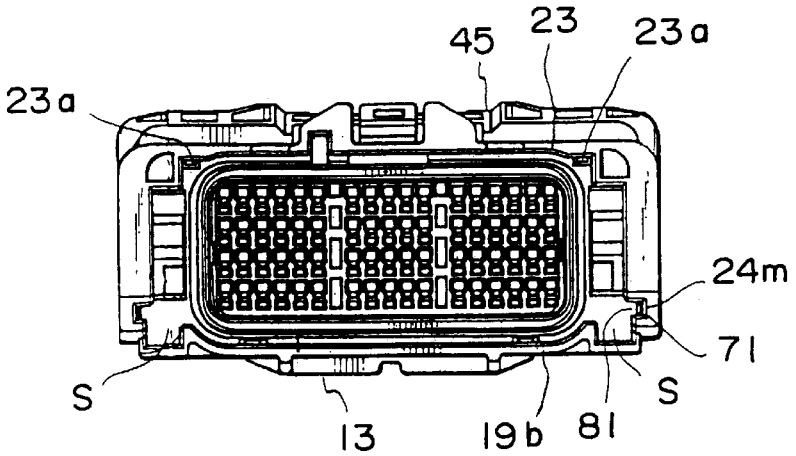
FIG. 14 is a front view showing a state in which a lever member in the connector assembly shown in FIG. 1 is rotated.

A temporary fitting device is constructed so that when the connector assembly 11 is temporarily connected to the counterpart connector 51, as shown in FIG. 13A, the connector assembly 11 does not easily disengaged from the counterpart connector 51. Referring to FIGS. 13A and 14, a pair of temporally fitting levers 23*a*, which are connected to the end of the fitting side and which extend backward, are provided at both ends in the longitudinal direction and at the inner surface of the frame bridge 23. The temporary fitting lever 23*a* has elasticity and a restoring property, and a free end thereof extends toward the upper surface of the fitting section 33.

On the other hand, the counterpart connector 51 has a pair of temporary fitting projections 59*a* which protrudes upward from both sides in the longitudinal direction of the counterpart fitting section 59. The pair of temporary fitting projections 59*a* is shown also in FIG. 1. The temporary fitting lever 23*a* and the temporary fitting projection 59*a* are combined and construct a temporary fitting device.

When the connector assembly 11 is fitted in the counterpart connector 51, the temporary fitting lever 23*a* is pressed while being deflected by the temporary fitting projection 59*a*, and the operation is continued until the temporarily fitted state shown in FIG. 13A. In the temporarily fitted state, the temporary fitting projection 59*a* engages with a free end of the temporary fitting lever 23*a*, and the connector assembly 11 cannot easily be disengaged from the counterpart connector 51 in the disconnecting direction Y in the temporarily fitted state.

When the connector assembly 11 is fitted in the counterpart connector 51 from the temporarily fitted state of the gear member 41, as shown in FIGS. 13A and 13B, the connector assembly 11 is moved in a direction in which the temporary fitting projection 59*a* is separated from the free end of the temporary fitting lever 23*a*.

Figure 15:
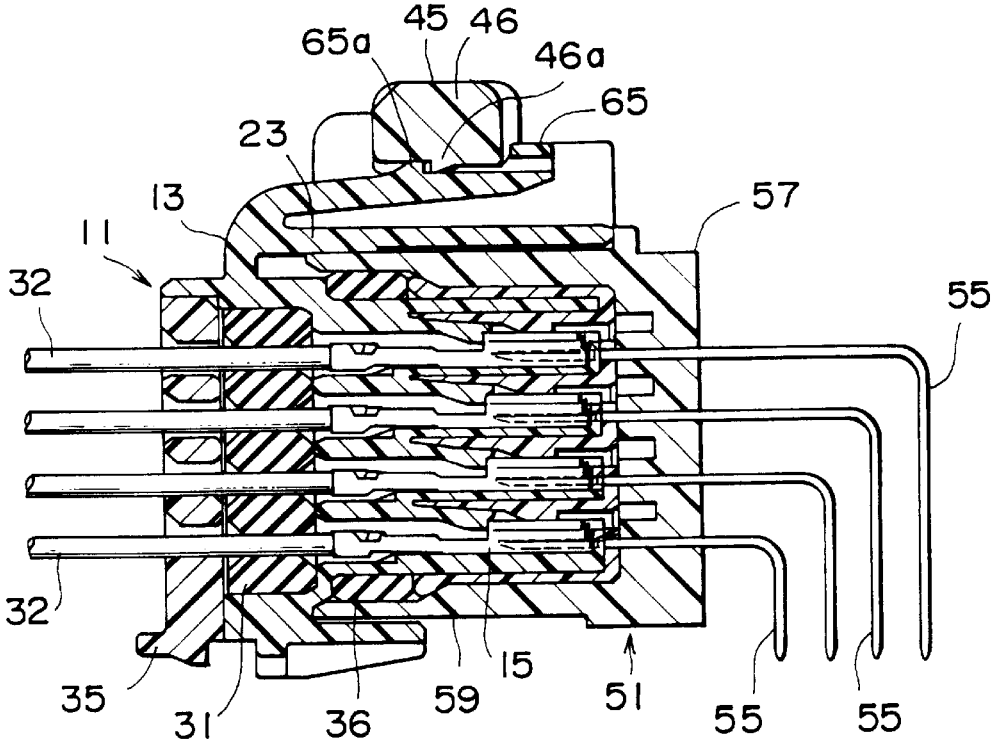
FIG. 15 is a cross sectional view showing a state in which an counterpart connector is connected to the connector assembly shown in FIG. 1.

Furthermore, when the connector assembly 11 is not connected to the counterpart connector 51, as shown in FIG. 13D, it is in a state before the temporary fitting projection 59*a* is temporarily fitted in the free end of the temporary fitting lever 23*a*. Accordingly, the connector assembly 11 can easily be withdrawn from the counterpart connector 51 in the disconnecting direction Y FIG. 15 shows a state in which the fit between the connector assembly 11 and the counterpart connector 51 is completed at a normal position by the fitting operation. A lever engaging device for holding the lever member 45 at the connector assembly 11 in conjunction with the lever member 45 is provided at a position at which the connector assembly 11 and the counterpart connector 51 are fitted.

The housing 13 has a lever-locking section 65 connected at the rear thereof. The lever-locking section 65 extends above the frame bridge 23 and is bendable. The lever-locking section 65 has a locking projection 65*a* at the center thereof. A portion including a lever pawl 46*a* which protrudes from the lower surface of the lever 46 goes over the locking projection 65*a*, thereby being engaged with the connector assembly 11.

In a state in which the lever claw 46*a* of the lever member 45 as a lever-locking device and the locking projection 65*a* are locked to each other, the lever member 45 cannot easily be rotated. In order to release the locked state of the lever, a free end of the lever-locking section 65 is pushed to be deflected, so that the engagement between the lever claw 45*a* and the locking projection 65*a* can be released.

Figure 16A:
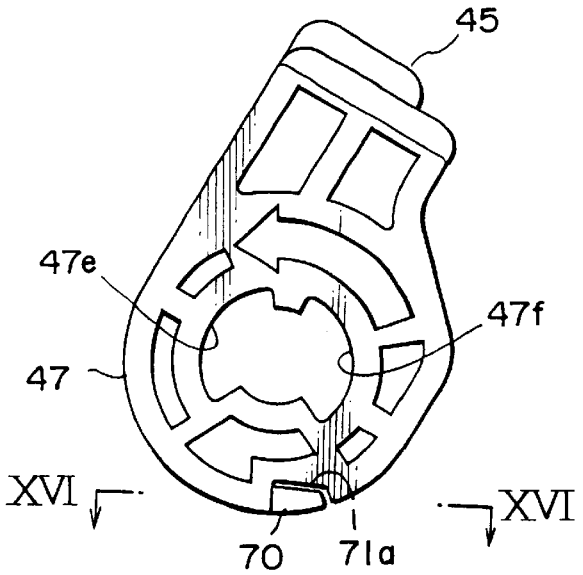
FIG. 16A is a side view of the lever member.
Figure 16B:
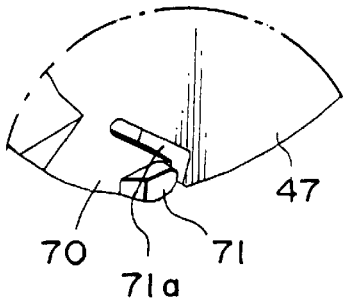
FIG. 16B is an enlarged side view of a part of the lever member.
Figure 16C:
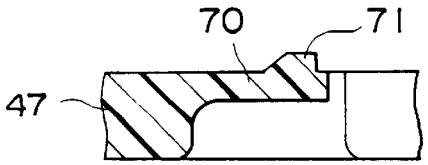
FIG. 16C is a cross sectional view taken along the line XVI—XVI in FIG. 16A.

Referring to FIGS. 16A to 16C, the lever member 45 shown in FIG. 11 will be described hereinbelow.

Each of the pair of gear-engagement receiving sections 47 of the lever member 45 has a rotation-stopping lever-locking piece 70 for retaining the lever member 45 in such a manner that the lever member 45 cannot easily be rotated while the gear member 41 is in the temporarily fixed state shown in FIGS. 3 and 13A. The lever-locking piece 70 extends in the circumferential direction of the gear-engagement receiving section 47 by forming a slit 71*a* in the vicinity of the periphery of the arc in a circumferential direction.

The lever-locking piece 70 has a thin planar shape in which one end thereof is connected to the gear-engagement receiving section 47 and the other end is free, thereby having elasticity and a restoring property. The free end of the lever-locking piece 70 has a lever-locking projection 71 which projects toward the surface facing each of the pair of gear-engagement receiving sections 47.

Figure 17A:
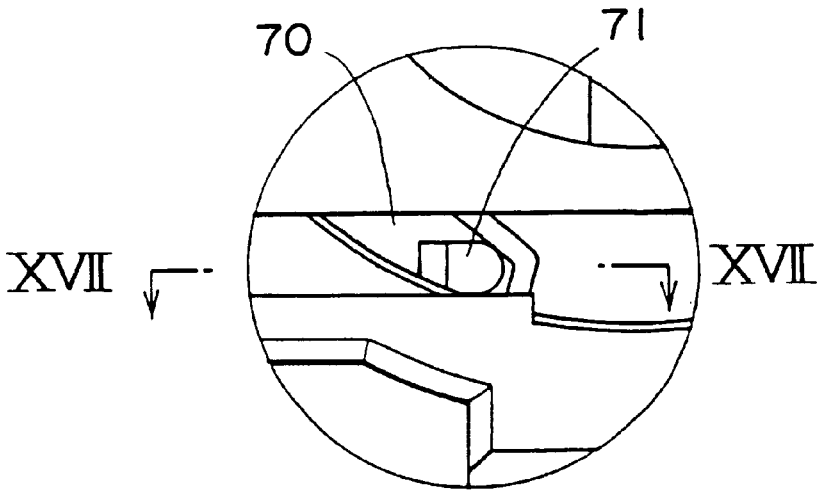
FIG. 17A is an enlarged side view showing an engaging relationship between the connector element and the lever member.
Figure 17B:
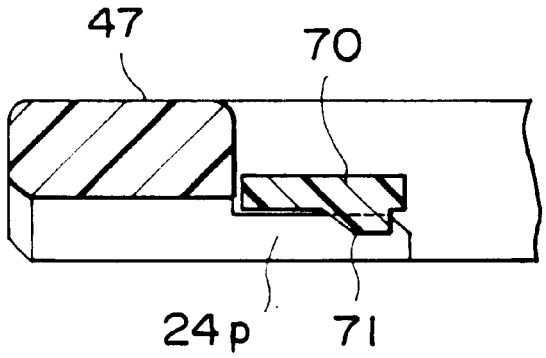
FIG. 17B is a cross sectional view taken along the line XVII—XVII in FIG. 17A.
Figure 18:
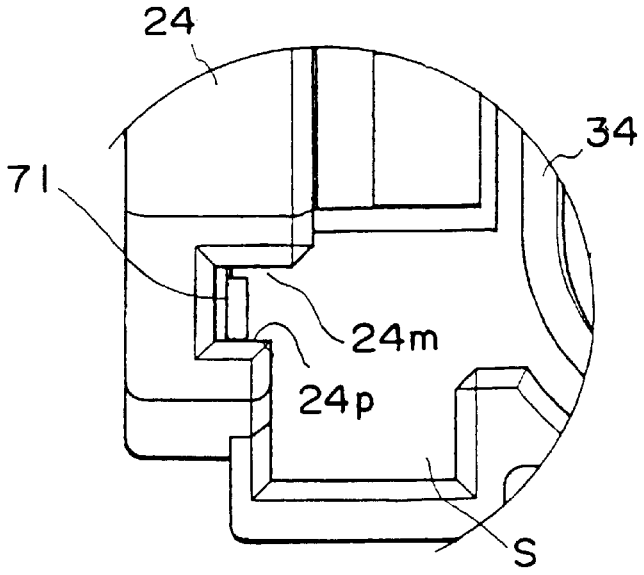
FIG. 18 is an enlarged front view showing an essential part of the connector element.

Referring to FIGS. 17A, 17B, and 18, the relationship between the connector element 21 and the lever member 45 will be described.

Each gear holding plate 24 has a projection receiving groove 24 m for receiving the lever-locking projection 71 of the lever-locking piece 70 in such a manner that it protrudes from the inner surface thereof. The projection receiving groove 24 m is formed in such a manner that it is connected to the space S on the outer periphery of the fitting section 34, into which the counterpart fitting section 59 of the counterpart connector 51 is fitted.

The lever member 45 has a structure in which it cannot be rotated unless the connector assembly 11 is temporarily connected to the counterpart connector 51. The lever-locking projection 71 is engaged with an engaging wall 24*p* formed at the projection receiving groove 24*m* of the gear holding plate 24 which is adjacent to the projection receiving groove 24*m*.

Figure 19:
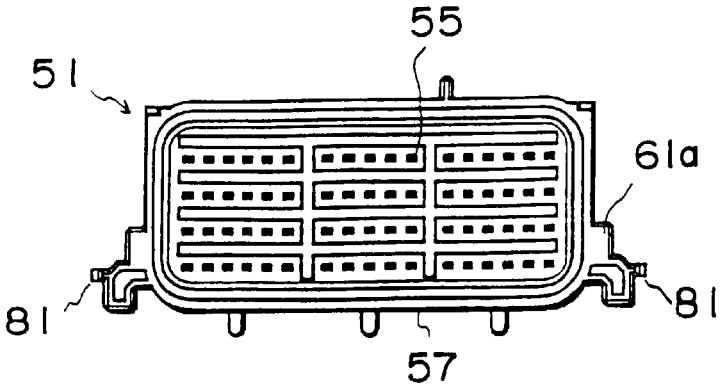
FIG. 19 is a front view of the counterpart connector.
Figure 20:
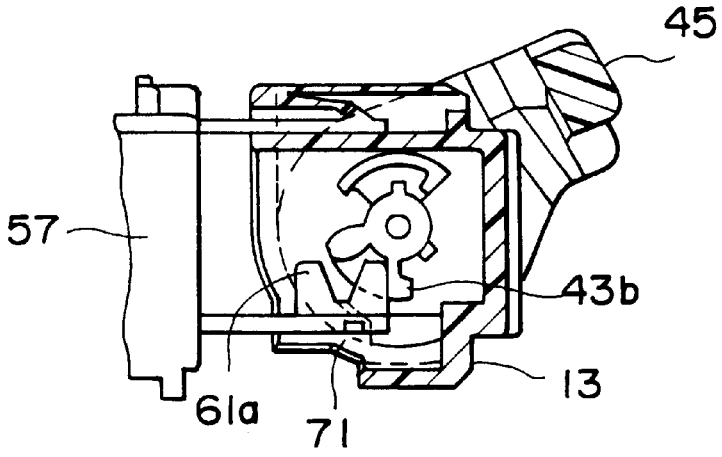
FIG. 20 is a cross sectional view showing a state in which the temporary fit between the lever member and the counterpart connector is released.
Figure 21:
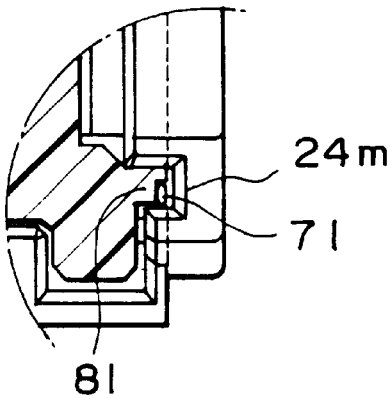
FIG. 21 is a cross sectional view of a part of the connector assembly shown in FIG. 14.

Referring to FIGS. 1 and 19, releasing ribs 81, which release the temporarily locked state of the lever member 45 to allow rotation, protrude outward from both outer sides of the counterpart connector 51. The lever-locking piece 70, the lever-locking projection 71, the engaging wall 24*p*, and the releasing rib 81 construct a lever-locking device and a releasing device.

Each of the releasing ribs 81 is positioned under the counterpart gears 61*a* and 61*b* and protrudes therefrom to the outside. The counterpart fitting section 59 including the releasing rib 81 and the counterpart gears 61*a* and 61*b* enters the space S on the outer periphery of the fitting section 34.

Referring to FIGS. 20, 21, and 22A to 22E, the operation to release the locked state will be described.

Figure 22A:
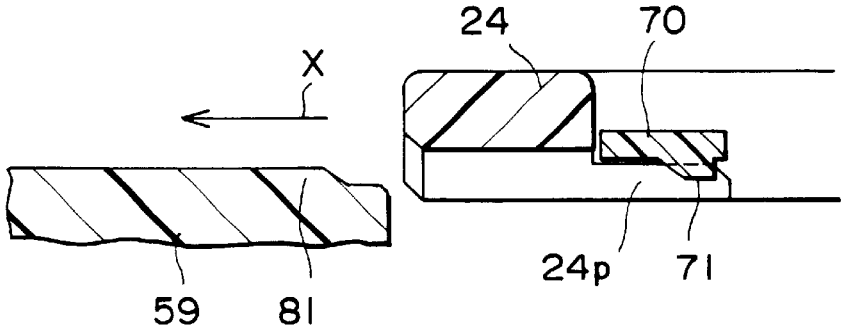
FIGS. 22A to 22E are cross sectional views of assistance in explaining the operation of the lever member.
Figure 22B:
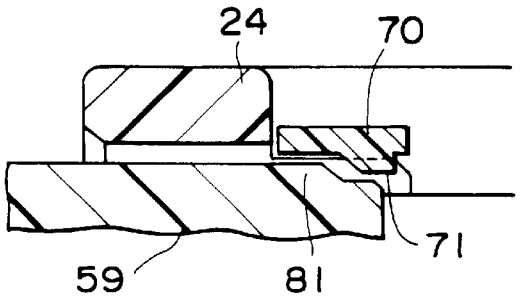
Figure 22C:
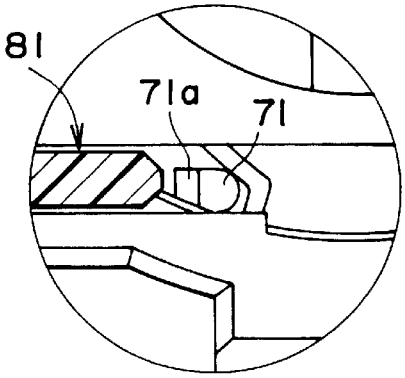
Figure 22D:
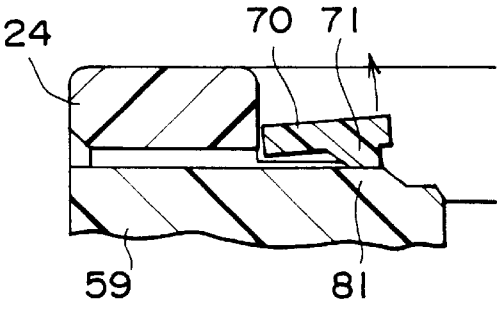
Figure 22E:
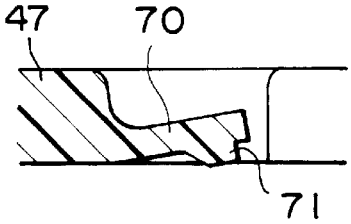

First, the fitting section 34 of the connector assembly 11 is brought cross to the counterpart fitting section 59 of the counterpart connector 51, as shown in FIG. 22A, and the fitting section 34 is then inserted in the counterpart fitting section 59 via the inlet of the projection receiving groove 24*m* of the lever mount 24. In this state, the counterpart fitting section 59 is positioned before the end of the releasing rib 81, as shown in FIGS. 22B and 22C. As the fitting section 34 of the connector assembly 11 is further fitted in the counterpart fitting section 59 of the counterpart connector 51, the lever-locking projection 71 of the lever-locking section 70 moves toward the releasing rib 81 in the projection receiving groove 24*m*. Subsequently, as the fitting section 34 of the connector assembly 11 is further fitted in the counterpart fitting section 59 of the counterpart connector 51, the lever-locking projection 71 is pressed to be displaced by the releasing rib 81, as shown in FIGS. 22D and 22E. Since the sloped slit 71*a* is formed at the lever-locking projection 71, the releasing rib 81 presses the lever-locking projection 71 while sliding on the sloped slit 71*a*. The engagement between the lever-locking projection 71 and the engaging wall 24*p* of the projection receiving groove 24*m*, which is formed on the gear holding plate 24*a*, is released. Accordingly, the lever member 45 can be freely rotated.

When th e lever member 45 in the state shown in FIG. 12A is rotated counterclockwise, the connector assembly 11 can be fitted in the counterpart connector 51 by the rotation of the lever member 45, as shown in FIG. 12B. At this time, the gear projection 44*j* which is engaged with the engaging hole 24*j* comes out therefrom and moves to a specified position of the guide groove 24*h* via the slope 24*h*'. In this way, the final fitting operation of the connector element 21 and the counterpart connector 51 is completed, as shown in FIG. 13C.

In this manner, elasticity of the lever-locking piece 70 of the lever member 45 is increased and the lever-locking piece 70 is easily raised by the force to temporarily fit the connector assembly 11 in the counterpart connector 51, so that the lock is released. Accordingly, the lever member 45 is rarely moved before fitting.

As described above, since the lever-locking projection 71 is integrally formed with the flexible lever-locking piece 70, when the connector assembly 11 is inserted in the counterpart connector 51, the releasing rib 81 of the counterpart connector 51 abuts on the temporary fixing lever-locking projection 71, and the lever-locking piece 70 is deflected, thereby easily releasing the locked state.

Since the fitting strength of the lever-locking projection 71 and the connector element 21 depends on the shearing strength of the fitted section, if the lever-locking projection 71 is increased in size, its strength can easily be increased.

In the connector assembly 11, when the connector element 21 is fitted in the counterpart connector 51, the contacts 15 and the counterpart contacts 55 come into contact with each other, and when the connector element 21 is disengaged from the counterpart connector 52, the contacts 15 and the counterpart contacts 55 are disconnected from each other. The gear member 41 is temporarily fitted in the lever mount 24 by the temporary gear-fitting device. The gear member 41 is inserted in the gear holding plate 24*a* and is rotated to a specified position, and the gear-engagement receiving section 47 of the lever member 45 is then engaged with the second engaging device 44 of the gear member 41 in one. When the gear member 41 is rotated, the connector element 21 is moved in a connecting direction or a disconnecting direction by the counterpart engaging device 61 which engages with the first engaging device 43. When the gear member 41 is returned to its normal position, the lever-engaging holes 47*e* and 47*f* formed in the gear-engagement receiving sections 47 of the lever member 45 are each engaged with the gear members 41, and when the gear members 41 are each engaged with the lever mounts 24, the gear members 41 are temporarily fixed in position. The connector element 21 and the lever member 45 are arranged in a state in which the lever 46 of the lever member 45 is inclined backward. In this state, the counterpart connector 51 can be fitted in the connector element 21. When the lever member 45 is moved above the frame 19, the gear-engagement receiving section 47 of the lever member 45 rotates the gear member 41, so that the gears 43*a* and 43*b* of the gear member 41 enter between the counterpart gears 61*a* and 61*b* of the counterpart connector 51, and are pressed to move the connector assembly 11 in a connecting direction. Furthermore, when the lever member 45 is moved above the frame 19, one end face of the lever member 45 comes into contact with the housing 13. At this time, the movement of the lever member 45 is stopped. The lever member 45 is locked in the connector element 21 by the lever-locking device and the lever-releasing device in conjunction with the lever member 15 at a position before the connector element 21 is temporarily fitted in the counterpart connector 51. The lever member 45 is not moved unless the connector element 21 is temporarily fitted in the counterpart connector 51. The connector element 21 is fitted in the counterpart connector 51, and thereby the engagement between the lever-locking piece 70 and the lever mount 24 is released by the lock-releasing counterpart rib of the counterpart connector 51, enabling the lever member 45 to be rotated.

According to the connector assembly 11, it is possible to simplify the dies for manufacturing parts, such as the lever member 45 and the gear member 41, which together comprise the manipulation mechanism 14. Since the dies for manufacturing the parts are simplified, the accuracy of the parts can easily be assured. Therefore, since deformation of the lever member 45 when the lever member 45 is assembled to the connector element 21 can be decreased, damage to the parts is prevented and the assembly becomes easy. In the manipulation mechanism 14, since the lever member 45 can be engaged with the gear member 41 in a state in which the gear member 41 is temporarily fixed in position on the connector element 21, the lever member 45 can easily be mounted. Furthermore, when the lever member 45 is temporarily fixed, the lever member 45 is firmly locked, and when it is temporarily connected, the lever-locking piece 70 is easily pressed to release the lock by the locking force. Accordingly, the risk that the lever member 45 is moved before connection is sufficiently decreased, the connection can be performed with a small force, and there is no need to return the lever member 45.

What is claimed is:

1. A connector assembly comprising a connector element for being connected to an counterpart connector in a first direction and a manipulation mechanism for manipulating the connection between the connector element and the counterpart connector, the manipulation mechanism comprising:

a gear member rotatably supported by the connector element; and a lever member non-integrated and engaged with the gear member in a rotating direction, the gear member comprising a gear section as first engaging means for engaging with the counterpart connector in the first direction to mate the connector element and the counterpart connector.

2. A connector assembly according to claim 1, wherein a locking member of the connector element engages the lever with the connector element in a state in which the connector assembly is connected, whereby the connector assembly is maintained in the connecting state.

3. A connector assembly according to claim 1, wherein the lever comprises a locking section, the connector element comprising a insulating housing and an engaging section which is connected to the housing and engaged with the locking section for stopping the lever from rotation thereof, at least one of the locking section and the engaging section having elasticity, the engagement between the locking section and the engaging section being released due to the elasticity, enabling the lever to be rotated when the counterpart connector is connected thereto.

4. A connector assembly according to claim 3, wherein the connector element comprises:

a fitting section which is connected to the housing and which is fitted in the counterpart connector;

an electrically conductive contact held in the fitting section; and a frame which is connected to the housing and which is separately disposed and faces the fitting section in the second direction; and a lever mount connected to the frame, the gear member being rotatably supported by the lever mount.

5. A connector assembly according to claim 1, wherein the connector element comprises a lever mount, the gear member further comprising:

a gear shaft which is rotatably mounted on the lever mount, which extends in a second direction perpendicularly crossing the first direction, and which has a first shaft end connected to the first engaging means and a second shaft end facing the first engaging means; and second engaging means which is connected to the second shaft end of the gear shaft and which is engaged with the lever member in the rotating direction.

6. A connector assembly according to claim 5, wherein the gear shaft comprises ribs which protrude from the periphery at the first shaft end, the lever mount comprising a bearing for supporting the gear shaft and notches connected to the bearing and allowing the ribs to pass therethrough.

7. A connector assembly comprising a connector element connected to the counterpart connector in a first direction and a manipulation mechanism for performing the connection of the connector element, the connector element comprising an insulating housing and a frame provided at the housing, the housing comprising a plurality of electrically conductive contacts and a fitting section which holds the contacts and is fitted in the counterpart connector, the frame comprising a lever mount which is separately disposed and faces the periphery of the fitting section in a second direction perpendicularly crossing the first direction, the manipulation mechanism comprising a gear member rotatably mounted on the lever mount and a lever member mounted on the lever mount via the gear member in such a manner as to be rotated together with the gear member, the gear member comprising a gear shaft having a first shaft end and a second shaft end, first engaging means provided at the first shaft end of the gear shaft, and second engaging means which is provided at the second shaft end of the gear shaft in such a manner that it deviates from the first engaging means at a predetermined angle of circumference and which protrudes from the periphery of the gear shaft in a radial direction, the first and the second engaging means engaging with the lever mount, the second engaging means engaging with the lever member.

8. A connector assembly according to claim 7, wherein the counterpart connector comprises an counterpart contact, an insulating counterpart housing having the counterpart contact, and counterpart engaging means for engaging with the first engaging means in the first direction, the counterpart housing comprising an counterpart fitting section in which a large groove is formed in such a manner as to cover the fitting section, the counterpart engaging means comprising a plurality of counterpart gear sections which protrude outward from the outer surface of the counterpart fitting section, the counterpart gear sections being integrally formed on the counterpart housing at a predetermined distance from each other in such a manner as to engage with the first engaging means in the first direction.

9. A connector assembly according to claim 8, wherein the lever mount comprises a rotation control plate extending upward from the surface of the gear holding plate, the lever member comprising an abutment surface which is formed on one end face thereof and which stops the rotation of the lever member at a specified position.

10. A connector assembly according to claim 7, further comprising lever-locking means for locking the lever member on the connector element in conjunction with the lever member in a state in which the fit between the connector and the counterpart connector is completed.

11. A connector assembly according to claim 10, wherein the lever-locking means comprises a lever-locking section one end of which is connected to the housing and which extends above the frame and a lever claw provided at the lever member, the lever-locking section comprising a locking projection which is locked in the lever claw.

12. A connector assembly according to claim 7, further comprising temporary fitting means provided on the connector element and the counterpart connector, for preventing the connector element from disengaging from the counterpart connector when the connector element and the counterpart connector are temporarily fitted to each other.

13. A connector assembly according to claim 12, wherein the temporary fitting means comprises a temporary fitting lever one end of which is connected to the frame and which extends from the fitting section in a fitting direction and a temporary fitting projection which protrudes above the counterpart fitting section, the temporary fitting lever having elasticity and a restoring property, a free end of the temporary fitting lever extending toward an upper surface of the fitting section, the temporary fitting projection and the temporary fitting lever being engaged with each other in the first direction when the connector element and the counterpart connector are temporarily fitted to each other.

14. A connector assembly according to claim 12, wherein the lever member, the lever mount, and the counterpart connector comprise lever-locking means for locking the lever member in the lever mount in a state before the lever member is engaged with the gear member and the connector element is temporarily fitted in the counterpart connector by the temporary fitting means after the gear member has been temporarily fixed to the gear holding plate, and lock releasing means for releasing the locked state when the connector element is temporarily fitted in the counterpart connector.

15. A connector assembly according to claim 14, wherein the lever-locking means and the lock releasing means comprise:

a rotation-stopping lever-locking piece having elasticity and a restoring property, and which is formed on the gear-engagement receiving section, for locking the lever member in the temporarily fixing state;

a projection receiving groove formed in the lever mount in connection with the space so that it encloses the lever-locking piece;

an engaging wall provided at the lever mount in such a manner that a free end of the lever-locking piece engages with a part of the projection receiving groove for locking; and a releasing rib which is formed at the counterpart fitting section of the counterpart connector, and in which, when the connector is temporarily fitted in the counterpart connector, the free end of the lever-locking piece is pressed to release the locked state.

16. A connector assembly according to claim 15, wherein a lever-locking projection is formed at the free end of the lever-locking piece which protrudes from the free end and which engages with the locking wall for locking.

17. A connector assembly according to claim 7, wherein the lever member comprises a lever which is rotatable along the frame and a gear-engagement receiving section provided in such a manner as to face the lever mount from both sides of the lever and to engage with the second engaging means, the lever mount comprising a gear holding plate which rotatably holds the gear member, the gear holding plate comprising a notch formed in a shape corresponding to the shape of the first engaging means so that it receives the first engaging means in the lever mount and a gear bearing formed in such a manner that it rotatably holds the gear shaft.

18. A connector assembly according to claim 17, wherein the gear-engagement receiving section of the lever member is engaged with the second gear plate in one in a state in which the gear member is temporarily fixed to the gear holding plate, the gear-engagement receiving section having a lever engaging hole having the same shape as that of the second gear plate so that the second gear plate can be fitted therein.

19. A connector assembly according to claim 17, wherein the first engaging means comprises a first gear plate extending from the periphery of the gear shaft in a radial direction and a plurality of first gear sections which extend from the first gear plate on the periphery of the gear shaft in a radial direction and which are arranged at a predetermined distance from each other in a peripheral direction of the gear shaft, the second engaging means comprising a plurality of second gear plates extending from the other end face of the shaft of the gear shaft in a radial direction.

20. A connector assembly according to claim 19, wherein the gear shaft comprises ribs which extend from the periphery thereof, the second gear plate coming in contact with the surface of the gear holding plate, the ribs abutting on the back of the gear holding plate.

21. A connector assembly according to claim 20, wherein the gear holding plate has notches which extend from the bearing in a radial direction so as to receive the ribs in the housing.

22. A connector assembly according to claim 17, wherein the gear holding plate and the first engaging means comprise temporary gear-fixing means in which the gear-engagement receiving section is temporarily engaged with the first engaging means of the gear member at a position in which the gear member engaged with the gear holding plate is rotated to a specified position.

23. A connector assembly according to claim 22, wherein the gear temporary-fixing means comprises a gear projection which protrudes from the second gear section and an engaging hole formed in the surface of the gear holding plate in such a manner that the gear projection is fitted therein so that the gear member is temporarily fixed to the connector element.

24. A connector assembly according to claim 23, wherein the gear holding plate comprises an arc-shaped guide groove formed on the surface thereof concentrically with the bearing in such a manner that it receives and guides the gear projection in the direction of its rotation, the engaging hole being formed in the vicinity of the guide groove.

25. A connector assembly according to claim 24, wherein the guide groove in the vicinity of the engaging hole has a slope which is inclined toward the surface of the gear holding plate, formed on the bottom thereof.

26. A connector assembly according to claim 24, wherein the guide groove is formed on each of both sides of the engaging hole, a pair of the guide grooves in the vicinity of the engaging hole each having a slope which is inclined toward the surface of the gear holding plate, formed on the bottom thereof.

27. A connector assembly according to claim 26, wherein the first engaging means, the gear shaft, and the ribs are fitted in the bearing, the gear notch, and the notches, respectively, in a state before the first engaging means is temporarily engaged with the gear holding section, the gear shaft being rotatably engaged with the gear notch, the first engaging means and the ribs being positioned at the back of the back surface opposite to the surface of the gear holding plate, the gear projection being positioned in the vicinity of the inlet of one of the guide grooves, which is positioned farthest from the slope.

* * * * *

UNITED STATES PATENT AND TRADEMARK OFFICE

CERTIFICATE OF CORRECTION

PATENT NO. : 6,371,778 B1
DATED : April 16, 2002
INVENTOR(S) : Watanabe

It is certified that error appears in the above-identified patent and that said Letters Patent is hereby corrected as shown below:

Column 1,
Lines 8-9, delete “manipulating connection” and insert -- manipulation a connection --
Line 9, delete “an” and insert -- a --

Column 3,
Line 43, delete “piece” and insert -- place --

Column 6,
Line 9, delete “slop” and insert -- slope --
Line 27, delete “44jfrom” and insert -- 44j from --

Column 7,
Line 13, delete “13C” and insert -- 13D --

Column 8,
Line 30, delete “Y” and insert -- Y. --

Column 9,
Lines 9 and 12, delete “24 m” and insert -- 24*m* --
Line 61, delete “th e” and insert -- the --

UNITED STATES PATENT AND TRADEMARK OFFICE

CERTIFICATE OF CORRECTION

PATENT NO. : 6,371,778 B1
DATED : April 16, 2002
INVENTOR(S) : Watanabe

It is certified that error appears in the above-identified patent and that said Letters Patent is hereby corrected as shown below:

Column 11,
Line 35, delete "the" and insert -- said --
Lines 36-40, delete "A connector assembly according to claim 1, wherein a locking member of the connector element engages the lever with the connector element in a state in which the connector assembly is connected, whereby the connector assembly is maintained in the connecting state." and insert -- A connector assembly according to claim 1, wherein a locking member of the connecting element engages the connector element in a state whereby the connector assembly is maintained in the connecting state. --

Signed and Sealed this

Sixth Day of May, 2003

JAMES E. ROGAN
*Director of the United States Patent and Trademark Office*